United States Patent [19]

Tinnes

[11] Patent Number: 4,759,479

[45] Date of Patent: Jul. 26, 1988

[54] APPARATUS AND METHOD FOR OSCILLATING SLIDE CLOSURE OF CASTING VESSEL TO PREVENT SOLIDIFICATION OF MOLTEN METAL IN CLOSED OUTLET

[75] Inventor: Bernhard Tinnes, Zurich, Switzerland

[73] Assignee: Metacon AG, Zurich, Switzerland

[21] Appl. No.: 381,504

[22] Filed: May 24, 1982

[30] Foreign Application Priority Data

Jun. 1, 1981 [CH] Switzerland ..... 3546/81

[51] Int. Cl.[4] ..... B22D 37/00

[52] U.S. Cl. ..... 222/600; 222/559; 222/196

[58] Field of Search ..... 222/597, 600, 591, 200, 222/196, 559, 561, 590, 146 H; 366/192, 193; 137/330

[56] References Cited

U.S. PATENT DOCUMENTS

| | | | |
|---|---|---|---|
| 3,040,768 | 6/1962 | Pippenger | 137/330 |
| 3,906,975 | 9/1975 | Craig | 137/330 X |
| 3,990,614 | 11/1976 | Matsuo et al. | 222/561 X |
| 3,997,090 | 12/1976 | Tinnes . | |
| 4,051,589 | 10/1977 | Tinnes . | |
| 4,076,153 | 2/1978 | Tinnes . | |
| 4,076,154 | 2/1978 | Tinnes . | |
| 4,077,457 | 3/1978 | Hashio et al. | 222/600 X |
| 4,092,771 | 6/1978 | Tinnes et al. . | |
| 4,269,399 | 5/1981 | Tinnes et al. . | |
| 4,273,315 | 6/1981 | Tinnes . | |

*Primary Examiner*—Joseph J. Rolla

*Attorney, Agent, or Firm*—Cushman, Darby & Cushman

[57] ABSTRACT

For a slide closure 10 attached to a pouring vessel 2 which has a movable slide part 14 disposed between a bottom plate 12 and a discharge part 16, there is, in addition to a cylinder piston unit 24 acting on the slide part, which unit is dominant by way of a servocontrol block 26 by regulating arrangement 32, a vibrator 36 which is controlled by an oscillator 34. The vibrator 36 is switched into the connection between the cylinder-piston unit 24 and the movable slide part 14, and is in a position to oscillatingly drive the latter both in its closing position as well as in other positions and, indeed, in the same direction as the cylinder piston unit. A position generator 44 starts the oscillator 34 forcibly in the closed position.

12 Claims, 1 Drawing Sheet

APPARATUS AND METHOD FOR OSCILLATING SLIDE CLOSURE OF CASTING VESSEL TO PREVENT SOLIDIFICATION OF MOLTEN METAL IN CLOSED OUTLET

BACKGROUND OF THE INVENTION

The invention relates to a casting arrangement for metallic melts.

In the case of the slider closures of pouring ladles and intermediate vessels for the pouring metallic melts, such as are shown in the U.S. Pat. No. 4,076,153, of Bernard Tinnes, isued Feb. 28, 1978, workers in the art have been striving for some time to meet the danger of solidification of the melt in the discharge channel or of the freezing of the slider closure. At the same time, measures have already become known which attempt to prevent the penetration of melt into the discharge channel prior to the pouring. For this purpose, the discharge channel in the case of an empty vessel is filled either with a nonmetallic filling mass or with a metal with a low melting point.

Apart from the expenditure of work represented by these known measures, the are effective only as long as the pouring has not yet started. It is also not possible to prevent the filling mass or the filling metal from reaching, for example, the permanent mold and there has a disturbing effect.

In order to be able to avoid not only prior to the tapping but also during the pouring or operational interruptions of a shorter duration, the freezing of the discharge channel of a pouring vessel equipped with a slider closure, it has likewise been known to blow gas into the discharge channel in the closed state of the slider, for example, an inert gas. Apertures for the entry of gas into the discharge channel are at the same time provided either directly in the perforated brick or in the perforated brick casing in the fixed bottom plate of the slide or in the movable slider plate itself, whereby in the latter case, the entry opening for the gas is connected with the discharge channel only in the closed slider position.

By the blowing-in of gas, one strives to stir the melt located in the discharge channel in order to mix colder melt with warmer melt and in order thereby to prevent solidification or delay it. As a rule, the blowing-in of air or other not-inert gases, as well as nitrogen, is prohibited for metallurgical reasons and therefore expensive, inert gas must be used. As a result of the blowing-in of gas, there will be not only increased operating costs, but the melt will also be cooled down by the entering cold gas. In addition, there is the danger that because of the active withdrawal of heat by the gas flow and to be sure both from the melt located in the discharge channel as well as from the fire-resistant material limiting this discharge channel and an insufficient supply of heat from the casting vessel, a sudden freezing will take place, for example, because of insufficient stirring.

The fact that the entry of gas into the discharge channel presupposes apertures or pores in these limiting fire-resistant parts, forces one during the operation to operate at any time with a higher gas pressure than the ferrostatic pressure in the discharge channel. This ferrostatic pressure, however, varies considerably with the level of the melt in the casting vessel, so that the effect of the blowing-in of gas changes to an impermissible extent, depending on the melt level or filling state. If, on the other hand, the pressure of the gas is not sufficient, then there is the danger of plugging-up the apertures or pores for the feeding of the gas. The corresponding parts will then have to be replaced before they would have to be exchanged for reasons of wear. This has a particularly unfavorable effect on the operating costs, which are already burdened by the use of inert gas, because of the more expensive parts needed for the blowing-in of gas.

SUMMARY OF THE INVENTION

It is the task of the invention to create an arrangement with which the freezing of the discharge channel both prior to the beginning as well as during the interruptions of the casting process due to operating conditions may be avoided reliably and without any significant increase of the operating cost.

According to the invention, the task set is solved through the fact that in the closing position the movable slide part is driven oscillatingly transversely to the discharge channel.

The solution according to the invention thus is not directed toward an exchange of colder melt with a warmer melt in the discharge channel by a rolling over of these melts. Rather, this solution is based on the realization that the solidification of a layer of melt resting on a flat surface may be delayed, whenever the delimiting surface is subjected to a back and forth movement in the plane.

With the invention, the formation of continuous solidification front in the layers of melt close to the wall directly above the movable slide part in the discharge channel is prevented. This is accomplished through the fact that by means of the oscillating movement of the movable slide part, shearing stresses are introduced into the melt in parallel to the main solidification front. At the same time, forces are transmitted apparently also into the zones of the discharge channel close to the wall, which lie at a certain distance from the movable slide part. In any case, one will succeed with the solution according to the invention in delaying the solidification itself even at temperatures which lie only a little above the liquidus temperature.

It has turned out that the frictional wear of the fire-resistant slider parts originating from the oscillation of the movable slider part is unexpectedly modest. However, the frictional wear altogether is also at the most slightly greater than in the case of conventional operation of the slide closure. An explanation for this fact is that, because of the oscillation of the movable slide part, the friction coefficient of rest does not occur and always the one of movement will be maintained. Therefore, measurably small adjusting forces will be needed for adjusting movements of the movable slide part which are introduced during the oscillation.

According to an advantageous further development of the casting arrangement, the oscillation drive has been provided also for other positions than the closing position of the movable slide part. Thus, for example, the oscillation drive may be provided also for the fully opened position or in the case of a controlled slide additionally for intermediate positions between the open and the closed position. Whenever the oscillation drive is superposed to the adjusting drive either directly or with regard to the corresponding signals, then the oscillation drive may be maintained in operation without interruption.

According to an advantageous further development, the casting arrangement according to the invention comprises a program control for opening and closing movements of the movable slide part to be carried out periodically. The program control determines at the same time the frequency, the size of the movement as well as the dwell time in the pertinent opened position. Preferably the program control may be put into operation either only in the closed position or possibly also in a partially open position of the movable slide part.

If such opening and closing movements are taking place from out of the closed position, then they will permit one to allow warmer melt from the casting ladle to keep flowing into the discharge channel, while colder melt emerges from the discharge channel. As a result of that, it will become possible to avoid solidification completely, even in the case of longer-lasting interruptions of castings. Since release through a very small opening or channel cross section during a very short time suffices, the melt flowing out during that time is always in a small quantity and may be absorbed without difficulty or may be caught at a slight additional expenditure.

The execution of the opening and closing movements from a throttled slider position is equally advantageous, whenever aluminum-killed steel, for example, is poured off from the casting vessel. In this case, it is recommended to select the stroke such that the movable slide plate will reach the fully opened position at the end of the opening movement. As a result of that, the flow path of the melt through the closure will follow a straight line. The oxide deposits which have formed in the throttled state preferably in the zones dead to the flow, are washed out. The slide closure needs to remain only for a short ime in the open position in order to remove the deposits. The quantity of melt flowing during this time is compensated by influencing the flow-through conditions prior to or after the opening-closing movement. In any case, the pouring arrangement according to the invention permits one to prevent the closing of the discharge channel by oxide deposits the generation of which cannot be avoided in the case of aluminum-killed steel.

BRIEF DESCRIPTION OF THE DRAWING

In the drawing, two embodiments of a pouring arrangement are shown by way of example and on the basis of which the invention will be explained in more detail.

DETAILED DESCRIPTION

Figure 1:
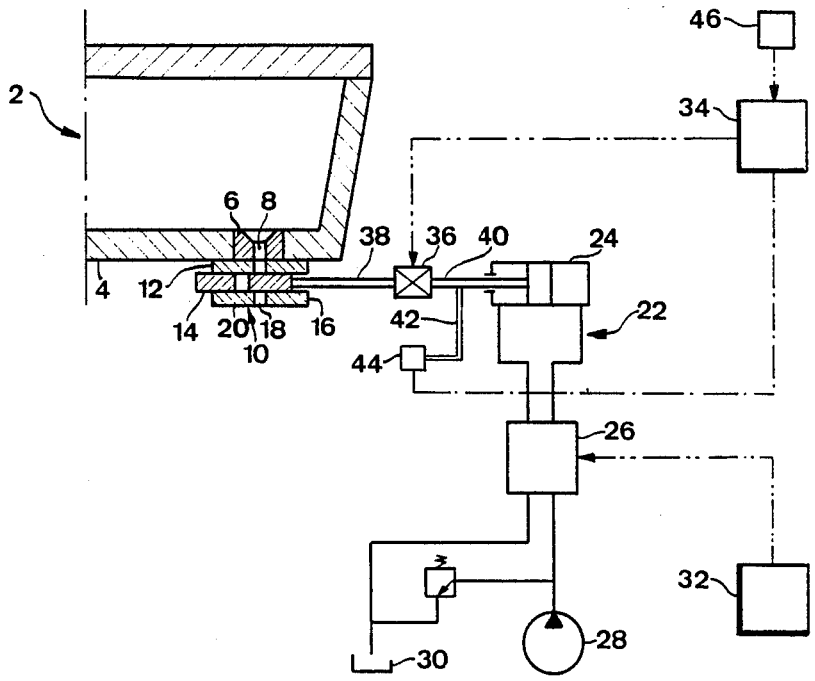
FIG. 1 shows a first embodiment of a pouring arrangement according to the invention.

In the drawing, 2 designates generally a schematically shown casting vessel (distributor) which has a perforated brick 6 inserted in its bottom 4. The perforated brick 6 limits an upper part of a discharge channel 8 which is continued downwards in the bottom plate 12 of a conventional slide closure designated generally 10. The slide closure 10 which likewise is only shown schematically comprises a plate-shaped, movable slide part 14 as well as a plate-shaped discharge part 16 connected rigidly with the bottom plate 12. The discharge part 16 has a discharge opening 18 aligned with the discharge channel 8, whereas the slide part 14 has a passage 20.

The slide part 14 clamped slidingly between the bottom plate 12 and the discharge part 16, but slidably transversely to the discharge channel 8, is movable by means of an operating apparatus designated generally by 22 between an open position in which the passage 20 also is aligned with the discharge channel 8 and the closed position shown in the drawing (FIGS. 1 and 2), in which latter position the connection between the discharge channel 8 and the discharge opening 18 is interrupted.

The operating apparatus 22 comprises a cylinder piston unit 24 in working connection with the slide part 14, which is connected by way of corresponding lines for a fluid medium with a servocontrol block 26. The servocontrol block 26 dominates in a known manner the cylinder-piston unit 24 and is connected as shown with a pump 28 and a tank 30 for liquid.

On the other hand, a schematically shown arrangement 32 acts on the servocontrol block 26, which regulating arrangement may either be operated manually or may be switched into a control circuit, not shown. The regulating arrangement 32 will permit the operation of the servocontrol block 26 for the production of the adjusting movements of the slide part 14.

In order to make possible the oscillating drive of the movable slide part 14 provided according to the invention, an oscillator 34 has been provided according to the embodiment shown FIG. 1, which is connected with the vibrator 36 and which causes the latter to produce oscillation movements of a predetermined frequency and amplitude. The vibrator 36 is inserted between parts 38 and 40 of a piston rod, which connect the cylinder piston unit 24 with the movable slide part 14.

In any case, in order to guarantee in its closing position the oscillating drive of the movable slide part 14, an arm 42 has been rigidly attached to part 40 of the piston rod, which arm cooperates in the closing position with a position generator 44, for example, in the form of a reed switch. The position generator 44 connected with the oscillator 34 turns on the vibrator before the movable slide part 14 has reached its fully closed position, for example, while there still exists a slight overlap between the discharge channel 8, the passage 20 and the discharge opening 18. Thus, the vibrator 36 is also turned on before the movable slide part has reached the closing position. On the other hand, the vibrator 36 will come to rest only, whenever the movable slide part 14 may be turned on and off in other opening positions of the latter by means of a manually operable switching element 46 which is connected with the oscillator 34.

The oscillator 34 may be adjustable in order to change the degree (stroke) and/or the temporal course of the oscillation movement on the movable slide part 14. While strokes in the order of magnitude of a few millimeters, for example 3 mm, are suitable, frequencies of 1–2 strokes per second have proved to be sufficient. Besides a sinusoidal course of the movement, other temporal courses too, come into consideration.

Figure 2:
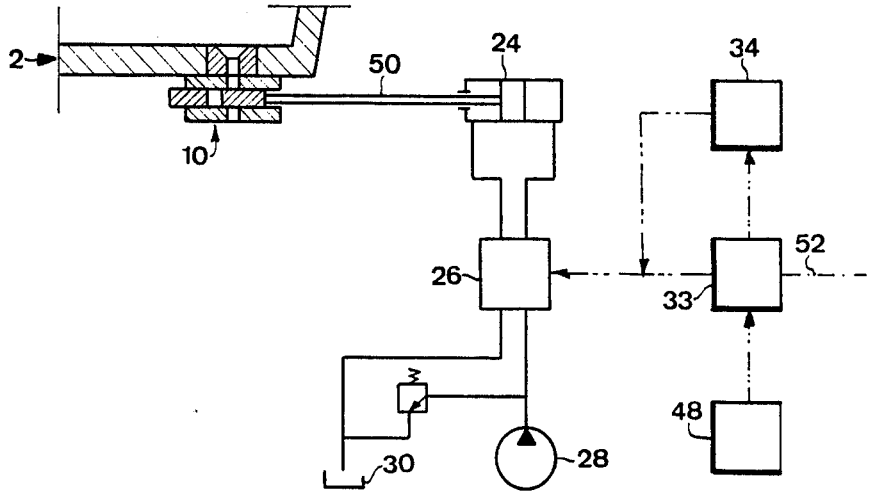
FIG. 2 shows the pouring arrangement according to the invention in a second embodiment.

The embodiment of the pouring arrangement shown in FIG. 2 has been designated for use in a continuous casting installation. Correspondingly, the regulating arrangement 33 connected with the servo-control block 26 shows an inlet 52 for signals of a measuring arrangement, not shown, which is attached to the permanent mold and measures the state of filling of it. Furthermore, a program control 48 is connected with the regulating arrangement 33 which, in predetermined states of the regulating arrangement, acts on the latter. Finally, the regulating arrangement 33 is connected with the oscillator 34 which, on its part, is in direct connection with the servocontrol block 26. The program control 48 puts the oscillator 34 into operation by way of the regulating arrangement, whenever the former allows the slide closure to move into the closing position. At the same time, the oscillator 34 has an overlapping effect on the control signal which is produced by the regulating arrangement 32. The oscillation movement is thus produced by the cylinder piston unit 24 producing the adjusting movements. Thus, any special-acting member, for example, in the form of the vibrator 36 according to FIG. 1, is omitted. The program control at the same time also induces the adjusting signals which interfere with the regulation and cause open and shut movements of the movable slide part 14 by way of the servocontrol block 26 and the cylinder piston unit 24.

Experiments which were made with the pouring arrangement according to the invention have produced astounding results. Thus, a pouring arrangement according to FIG. 2, for example, was used in a continuous casting installation. The discharge channel 8 had a diameter of 45 mm. From the pouring vessel or distributor 2, a low-alloyed structural steel with a content of 0.04–0.05% of metallic aluminum and a temperature which in the mean lay 20° C. above the liquidus temperature, was poured.

During the interruptions in pouring, which were necessary by the installation, the slide part 14 moved into the closing position, was controlled by the oscillator 34 and was driven oscillatingly. Two complete oscillations per second consisting of a stroke of 3 mm in the direction, were carried out. At the same time, the passage 20 remained completely covered by the bottom plate 12.

It was possible with the described measure to renew the pouring operation after interruptions of a duration of 2 minutes, again regularly. The movable slide part could be moved without difficulties into an open position and the exit of melt from the discharge opening 18 could be started without delay.

In the case of another experiment repeated several times with this pouring installation and with the same conditions concerning composition and temperature of the melt, the program control was turned on during the interruptions of pouring. At the same time, the program control caused an interruption of the oscillation movements ever 30 seconds by an open and shut movement of the movable slide part. The length of stroke was set such that the movable slide part in one terminal position on the discharge channel released a gap of 3 to 5 mm width; the dwell time in this position amounted to 1 second. The melt flowing out during these open-shut movements, reached the permanent mold and could be absorbed during 3 minutes without exceeding the volumes reserve existing in it or forming by contraction of the casting. The resumption of the pouring operation that took place after this duration of interruption was without problem and no signs whatever of the freezing of the discharge channel could be found.

I claim:

1. A casting vessel having a discharge channel from which hot molten metal may be selectively poured, said discharge channel having an opening which is controlled by a slide closure having operating means for selectively transversally slidably shifting the slide closure between a closed position in which the slide closure obstructs the casting vessel discharge channel opening and an open position, said casting vessel further including means associated with said operating means for substantially reciprocatingly oscillating the slide closure when said slide closure is at least substantially in said closed position with sufficient frequency and amplitude to diminish the likelihood that molten metal will solidify in said discharge channel and that the slide closure will freeze in its at least substantially closed position, yet with insufficient amplitude to permit material loss of molten metal from the casting vessel while the slide closure is being so oscillated.

2. The apparatus of claim 1, wherein:

said means for oscillating includes means for adjusting the frequency and amplitude of oscillation of the slide closure.

3. The apparatus of claim 1, wherein:

said operating means comprises a reciprocable rod attached to the slide closure and means for reciprocating the rod, and where the means for oscillating includes a vibrator operatively connected to said rod.

4. For use with a casting vessel from which hot molten metal may be selectively poured through a discharge channel, the opening of which is controlled by a slide closure having operating means for selectively transversally slidably shifting the slide closure between a closed position in which the slide closure obstructs the casting vessel discharge channel opening and an open position, means associated with said operating means for oscillating the slide closure when said slide closure is at least substantially in said closed position with sufficient frequency and amplitude to diminish the likelihood that molten metal will solidify in said discharge channel and that the slide closure will freeze in its at least substantially closed position, yet with insufficient amplitude to permit material loss of molten metal from the casting vessel while the slide closure is being so oscillated;

said means for oscillating including means for sensing that the slide closure is almost in said closed condition and for initiating oscillation of the slide closure when said slide closure remains slightly out of said closed condition towards said open condition, so that a minor amount of leakage occurs during oscillation of the slide closure by said oscillating means.

5. For use with a casting vessel from which hot molten metal may be selectively poured through a discharge channel, the opening of which is controlled by a slide closure having operating means for selectively transversally slidably shifting the slide closure between a closed position in which the slide closure obstructs the casting vessel discharge channel opening and an open position, means associated with said operating means for oscillating the slide closure when said slide closure is at least substantially in said closed position with sufficient frequency and amplitude to diminish the likelihood that molten metal will solidify in said discharge channel and that the slide closure will freeze in its at least substantially closed position, yet with insufficient amplitude to permit material loss of molten metal from the casting vessel while the slide closure is being so oscillated;

said operating means comprising a reciprocable rod attached to the slide closure and means for reciprocating the rod, and the means for oscillating including a position sensor operatively connected to an oscillator, and an arm mounted to said rod for activating said position sensor upon reciprocation of said rod.

6. For use with a casting vessel from which hot molten metal may be selectively poured through a discharge channel, the opening of which is controlled by a slide closure having operating means for selectively transversally slidably shifting the slide closure between a closed position in which the slide closure obstructs the casting vessel discharge channel opening and an open position, means associated with said operating means for oscillating the slide closure when said slide closure is at least in said closed position with sufficient frequency and amplitude to substantially diminish the likelihood that molten metal will solidify in said discharge channel and that the slide closure will freeze in its at least substantially closed position, yet with insufficient amplitude to permit material loss of molten metal from the casting vessel while the slide closure is being so oscillated;

said operating means comprising a reciprocable rod attached to the slide closure; servo-controlled piston-cylinder means for reciprocating the rod; a regulating arrangement operatively associated with the servo-controlled piston-cylinder means for maintaining the slide closure in its condition so long as a mold that is to be filled remains partly empty; and means for sensing the fullness of the mold and for providing a respective signal to said regulating arrangement, and the means for oscillating including an oscillator operatively connected with said servo-controlled piston-cylinder means, and a program control means for initiating oscillation of said rod via oscillatory operation of said servo-controlled piston-cylinder means when in connection with receipt by said regulating arrangement of said respective signal said slide closure is shifted at least substantially to its closed position.

7. The apparatus of claim 6, wherein:

said program control means is constructed and arranged to provide a pattern of oscillations of differing amplitude, in which during some of said oscillations, said side closure remains in said closed position and in others said slide closure is slightly opened so as to permit a minor amount of leakage of molten metal therethrough.

8. A molten metal casting arrangement comprising:

a casting vessel from which hot molten metal may be selectively poured through a discharge channel, the opening of which is controlled by a slide closure having operating means for selectively transversally slidably shifting the slide closure between a closed position in which the slide closure obstructs the casting vessel discharge channel opening and an open position, means associated with said operating means for reciprocatingly oscillating the slide closure when said slide closure is at least substantially in said closed position with sufficient frequency and amplitude to substantially diminish the likelihood that molten metal will solidify in said discharge channel and that the slide closure will freeze in its at least substantially closed position, yet with insufficient amplitude to permit material loss of molten metal from the casting vessel while the slide closure is being so oscillated.

9. A casting vessel having a discharge channel from which hot molten metal may be selectively poured, said discharge channel having an opening which is controlled by a slide closure having operating means for selectively transversally slidably shifting the slide closure between a closed position in which the slide closure obstructs the casting vessel discharge channel opening and an open position, said casting vessel further including means associated with said operating means for substantially reciprocatingly oscillating the slide closure.

10. For use with a casting vessel from which hot molten metal may be selectively poured through a discharge channel, the opening of which is controlled by a slide closure having operating means for selectively transversally slidably shifting the slide closure between a closed position in which the slide closure obstructs the casting vessel discharge channel opening and an open position, means associated with said operating means for oscillating the slide closure;

program control means being provided for initiating stroke movement of the slide closure in the opening direction from an assumed position while said operating means are effective and for initiating return stroke movement to said assumed position within a predetermined interval.

11. A method for substantially diminishing the likelihood that molten metal, that is contained in a casting vessel having a discharge channel controlled by a slide closure which is transversally slidably shiftable between a closed position and an open position, will solidify in the discharge channel and that the slide closure will freeze closed or substantially closed, said method comprising:

when the slide closure is at least closed, substantially reciprocatingly oscillating the slide closure with sufficient frequency and amplitude to substantially diminish said likelihood yet with insufficient frequency and amplitude to permit material loss of molten metal from the casting vessel while the slide closure is being so oscillated.

12. A method for substantially diminishing the likelihood that molten metal, that is contained in a casting vessel having a discharge channel controlled by a slide closure which is transversally slidably shiftable between a closed position and an open position, will solidify in the discharge channel and that the slide closure will freeze closed or substantially closed, said method comprising:

when the slide closure is at least substantially closed, oscillating the slide closure with sufficient frequency and amplitude to diminish said likelihood yet with insufficient frequency and amplitude to permit material loss of molten metal from the casting vessel while the slide closure is being so oscillated;

said oscillating being carried out according to a pattern in which during most oscillations the slide closure remains substantially in said closed positions but in a few oscillations, the slide closure is momentarily moved at least partially into said open position.

* * * * *